US007147574B2

(12) United States Patent
Vesligaj

(10) Patent No.: US 7,147,574 B2
(45) Date of Patent: Dec. 12, 2006

(54) GOLF CLUB HEAD

(76) Inventor: Zeljko Vesligaj, P.O. Box 249 210 Progress Dr., Burgaw, NC (US) 28425

( * ) Notice: Subject to any disclaimer, the term of this patent is extended or adjusted under 35 U.S.C. 154(b) by 34 days.

(21) Appl. No.: 10/823,917

(22) Filed: Apr. 14, 2004

(65) Prior Publication Data

US 2005/0233826 A1 Oct. 20, 2005

(51) Int. Cl.
*A63B 53/04* (2006.01)

(52) U.S. Cl. ..... 473/329; 473/332; 473/340; 473/342; 473/349

(58) Field of Classification Search ..... 473/324–350
See application file for complete search history.

(56) References Cited

U.S. PATENT DOCUMENTS

| | | | | | |
|---|---|---|---|---|---|
| 3,843,122 | A | * | 10/1974 | Florian | 473/329 |
| 3,873,094 | A | * | 3/1975 | Sebo et al. | 473/250 |
| 4,199,144 | A | | 4/1980 | Skelly | |
| 4,324,404 | A | * | 4/1982 | Dian | 473/340 |
| 4,650,626 | A | * | 3/1987 | Kurokawa | 264/278 |
| 4,681,322 | A | * | 7/1987 | Straza et al. | 473/329 |
| 4,992,236 | A | | 2/1991 | Shira | |
| 5,062,638 | A | | 11/1991 | Shira | |
| 5,083,778 | A | | 1/1992 | Douglass | |
| 5,094,810 | A | | 3/1992 | Shira | |
| 5,306,450 | A | * | 4/1994 | Okumoto et al. | 264/45.1 |
| 5,324,031 | A | * | 6/1994 | Green | 473/252 |
| 5,531,439 | A | * | 7/1996 | Azzarella | 473/331 |
| 5,665,014 | A | | 9/1997 | Sanford et al. | |
| 5,669,825 | A | | 9/1997 | Shira | |
| 5,674,132 | A | | 10/1997 | Fisher | |
| 6,012,989 | A | * | 1/2000 | Saksun, Sr. | 473/341 |
| 6,217,460 | B1 | * | 4/2001 | Broadbridge et al. | 473/324 |
| 6,227,986 | B1 | | 5/2001 | Fisher | |
| 6,379,263 | B1 | | 4/2002 | Erickson et al. | |
| 6,475,427 | B1 | | 11/2002 | Deshmukh et al. | |
| 6,478,842 | B1 | | 11/2002 | Gressel et al. | |
| 2003/0216191 | A1 | * | 11/2003 | Wright et al. | 473/288 |

* cited by examiner

*Primary Examiner*—Sebastiano Passaniti
(74) *Attorney, Agent, or Firm*—MacCord Mason PLLC

(57) ABSTRACT

A golf club head having a front surface with a substantially planar face, a lower edge and a ball impact area, is constructed with a composite core of metal and plastic, with the core being enclosed in an injection molded plastic sheath. The core may be formed of layers of metal and plastic, or an injection molded plastic having metal particles dispersed therein. The metal to plastic weight ratio is preferably from about 90:10 to about 10:90. For putter heads, the head also includes a resilient section in the front surface having a face flush with the front surface, a lower edge aligned with the front surface lower edge, and an upper edge below the ball initial impact area. An exposed section of the non-resilient core may serve as the initial striking surface, while a front section of the resilient sheath may serve as the second ball striking surface.

18 Claims, 3 Drawing Sheets

GOLF CLUB HEAD

BACKGROUND OF THE INVENTION (1) Field of the Invention

The present invention relates to improved golf club heads, and in particular to golf club heads having the same exterior dimensions and different weights. The invention also relates to golf club putter heads having a resilient frontal section below the ball impact area.

(2) Description of the Prior Art

A limited number of golf club heads are still made by metal forging in the case of irons, or machining and finishing blocks of wood in the case of woods. Most golf clubs, however, are now made by metal casting in which a powdered metal is packed into a mold and then sintered to form the head. A binder may be used to hold the metal particles together during molding, with the binder being removed during sintering, i.e., heating the metal to a temperature of about 2400° F. The weight of the club head may be changed without changing the dimensions of the golf club by using metals or metal alloys having different densities.

U.S. Pat. No. 4,912,830 to the current inventor discloses production of a golf club head by injection molding a smooth plastic sheath or covering around a metal insert, with the weight of the club being changed by using different metals for the insert. The insert may be cast or machined.

Production of golf club heads by the foregoing methods is expensive in the case of sintered heads, and provide limited latitude in weight adjustment. Thus, there is a continuing need for a relatively inexpensive method of manufacturing a golf club head, enabling the production of golf club heads with a wide range of weights, but with the same outer dimensions.

There is an additional need for an improved golf club putter head. Numerous designs have been proposed for golf putter heads that purport to enable the golfer to accurately putt the ball. Many of these prior art designs disclose the use of resilient inserts in the front surface of the putter so that the ball will be initially struck by the resilient insert instead of the non-resilient putter, which is normally metal as described above.

Most prior art descriptions of putters with resilient face inserts, allege that the insert improves the "feel" or "touch" of the putter against the ball, resulting in a more accurate putt. Resilient inserts are also said to enlarge the "sweet spot." Since the resilient insert absorbs some of the impact of the club head against the ball, a ball struck with the same force as with a putter having an insert will not travel as far as a ball struck with a non-insert club head. Despite the large number of putters described in the prior art, there is still a need for a putter that will increase the accuracy of a putt without sacrificing the distance that the ball can be hit with a given force.

SUMMARY OF THE INVENTION

In accordance with the present invention, it has been found that high quality golf club heads can be produced at different weights, but with the same outer dimensions by first forming an inner composite core of a metal combined with a plastic, and then fully enclosing the inner core in an injection molded sheath or outer covering. While the invention will be specifically described with reference to a putter head, the invention is also applicable to heads of drivers and other golf clubs, unless the invention is specifically stated to be a golf putter head.

The composite core may be constructed in one of two ways. In the first and preferred embodiment, the composite core is formed by uniformily mixing or compounding a metal in particulate form with a polymer in particulate form to form a uniform blend of the metal and polymer. The mixture is then injection molded in a known manner to form the composite core. The resultant core is comprised of a polymeric matrix having the metal particles uniformly dispersed in the polymer.

In an alternative embodiment, the core is formed of thin plates or sheets of metal and polymer. Preferably, the weight to weight ratio of metal to polymer in either embodiment is from about 90:10 to about 10:90, and more commonly from about 50:50 to about 70:30. The weight of the core, and thereby the weight of the finished head, is changed by changing the ratio of metal to polymer. For example, the percentage of metal particles in the blend can be changed, or the number and/or thickness of metal plates relative to polymer plates can be changed.

Since the inner core is covered by an outer sheath in the final head, a wide variety of metals and polymers can be used to construct the core, so long as the resulting core is of sufficient strength and integrity to withstand the forces exerted against the club head during use. Moreover, there is no need to provide a high degree of finish to the core, since it will be covered.

Representative metals that can be used in construction of the core include beryllium, copper, steel, aluminum, steel, nickel, titanium, and mixtures and alloys thereof. When used in the preferred embodiment, the metal will be in particulate or powder form, with a particle size of from about 0.002 inch to about 0.01 inch, and preferably from about 0.002 inch to about 0.03 inch. When in sheet form, the metal sheets will normally have a thickness of from about 0.063 inch to about 0.125 inch.

Representative polymers used in the core include nylon, polycarbonate, and various elastomers. When in sheet form, the polymer sheets will normally have a thickness of from about 0.2 inch to about 0.4 inch, and preferably from about 0.125 inch to about 0.5 inch.

The club head sheath is formed over the composite core by injection molding using a mold that imparts the desired degree of finish to the outer surface of the sheath. The sheath material is an injection moldable polymer, which may also include metal particles. While the sheath composition may be the same as the core composition, a different composition for the sheath will normally be used, since the sheath will be visible and subjected to environmental and stress conditions. Preferably, the sheath is formed of a polymer selected from nylon, polycarbonate, Velox, etc. Metal particles, if used in the sheath composition, are preferably selected from the group consisting of brass, bronze, etc., and will have particle sizes as noted above for metal particles used in the core. The sheath preferably has a thickness of from about 0.125 inch to about 0.25 inch.

In constructing the club head, the core is manufactured, and then supported in an injection mold in which the outer sheath is formed over the core. The composite core, the particulate metal and polymer are uniformly blended together and then injected into a mold having exterior dimensions in the shape of the final club head, but of smaller dimensions, e.g., about 0.0125 to about 0.25 inch less at each surface than the final head. The molded core is then positioned in a final mold having the desired dimensions of the final head, with a space to receive the polymer for the sheath between the wall of the mold cavity and the composite core.

The sheath polymer is then injected between the mold wall and core and the part is allowed to cool.

Accurate positioning of the composite core within the final mold is necessary in order to produce a covering with a uniform thickness. For this reason, the composite core may be molded with recesses in its lower surface, e.g., parallel bores. A wall of the final mold may then include projections, e.g., rods that correspond to the bores. The composite core is then mounted on the rods.

In the alternative embodiment, the core is formed by stacking together sheets of metal and polymer having an outer periphery corresponding to, but slightly less than, the outer dimensions of the final club head. These sheets may also have coinciding through holes, so that the sheets can be supported on rods as noted above during molding of the outer covering. After the finished club head is removed from the final mold, the bores used to insert the rods are covered by covers or plugs that then form a part of the covering. Normally, these covers will be of the same composition as the club sheath.

Dependent upon the type of club and its design, the club head may include a hosel or attachment means to secure a club shaft at the desired alignment to the club head. Alternatively, the shaft can be inserted into a bore in the club head. Various ways to attach a shaft to a club head are known in the prior art and do not per se form a part of the present invention. Similarly, enhancements such as guides can be added to the final golf club head in accordance with means known to the skilled artisan.

The present invention also relates to the inclusion of an insert in golf putter heads, whether the putter head body is constructed as described above, or in another manner, including from a solid material. For purposes of this aspect of the invention, it is only necessary for the putter body to have a front surface with an outer face, a lower edge and a ball impact area. In accordance with this aspect of the invention, the club head includes a resilient section in its front surface, with the resilient section having a face in a plane with, i.e., flush with, the putter head front surface face, a lower edge aligned with the putter head front surface lower edge, and an upper edge below the ball impact area.

The front surface of the putter head is planar or substantially planar. When the putter head is placed behind a golf ball in position to strike the ball, the face of the putter may incline slightly rearwardly from the horizontal lower surface of the putter head, e.g., up to about 10°. The ball impact area, i.e., the area of the putter front surface that first contacts the ball, is normally located centrally of the horizontal axis of the putter front surface. Since the lower surface of the putter head is normally held slightly, e.g., about 0.25 inch, above the ground when striking the ball, and since the diameter of a golf ball is about 1.7 inch, the strike area will be located about 0.6 inch above the lower edge of the putter front surface.

The resilient section is formed of a resilient material, e.g., rubber, a resilient plastic, or an elastomer. Preferably, the insert has a durometer value of from about 40 to about 80. The width of the insert will normally be from about 50% to about 100% of the golf ball diameter or a width of from about 50% to about 80% of the width of the putter head lower edge. Thus, when the putter strikes the ball, the ball will contact the putter front surface on the impact area above the insert, and does not contact the insert when initially struck.

When the ball is initially struck, the ball is propelled forward a slight distance while the putter continues to move forward, essentially pushing the ball forward. The resilient insert engages the ball at a slightly upward tangent to the arc of the club swing as the ball and club head move forward. The frictional engagement of the insert and ball, enhanced by the resilience of the insert, imparts a forward spin to the ball. This spin minimizes drift of the ball from the direction in which it is hit, thereby increasing the accuracy of the putt.

As noted above, the insert may be fitted into a recess in the lower edge of the front surface of a putter that is constructed with a composite core and injection molded covering as described above. However, it is within the scope of the present invention to provide putter heads with inserts of the described configuration in which the putter head is constructed of a different material, e.g., a solid metal, wood or plastic, or a head in which a different type of core is covered by a plastic covering.

In an alternative embodiment, the putter core is manufactured of a non-resilient material, which may be a composite as described above, a solid metal, etc., enclosed in a sheath of resilient material, e.g., a resilient plastic or elastomer of the type described above. A section of the non-resilient core that is not covered by the sheath material forms the ball striking area of the putter face. For example, the core can be molded with a protrusion on the face surface at the ball striking area. The core is then covered by the sheath material, except for the front of the protrusion.

Thus, in this embodiment, the ball will be initially struck by the non-resilient core section that extends to the face of the putter, and then will be struck by the resilient sheath section that is located beneath the core section.

Various other modifications of the invention will be apparent to one skilled in the art upon a reading of the following detailed description of a preferred embodiment of the invention, taken with the drawings.

DETAILED DESCRIPTION OF THE INVENTION

In the following description, terms such as horizontal, upright, vertical, above, below, beneath, and the like, are used solely for the purpose of clarity in illustrating the invention, and should not be taken as words of limitation. The drawings are for the purpose of illustrating the invention and are not intended to be to scale.

Figure 1:
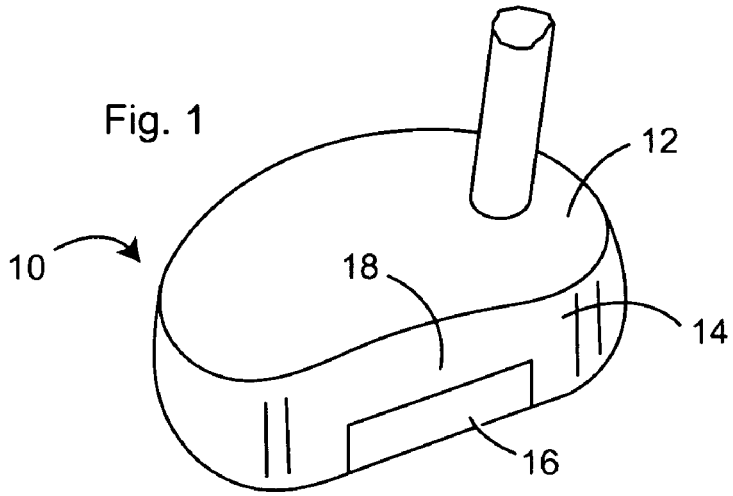
FIG. 1 is a perspective view of a golf club head and partial shaft.

As best shown in FIG. 1, golf 245 club putter head, generally 10, includes a body 12 having a front surface 14 with an insert 16. Front surface 14 includes an initial ball impact area 18 above insert 16.

Figure 2:
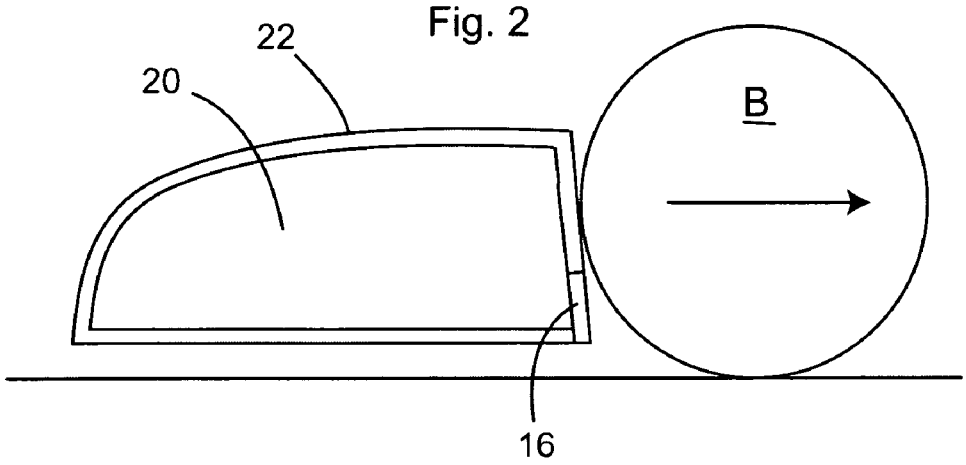
FIG. 2 is a sectional side view of the golf club head of FIG. 1 initially striking a golf ball.
Figure 3:
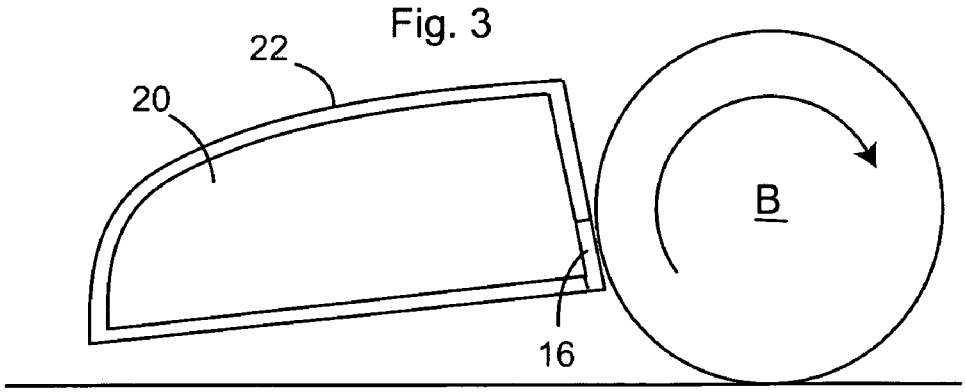
FIG. 3 is a sectional side view of the golf club head of FIG. 1 showing contact of a golf ball with the resilient insert to impart spin to the ball.
Figure 6:
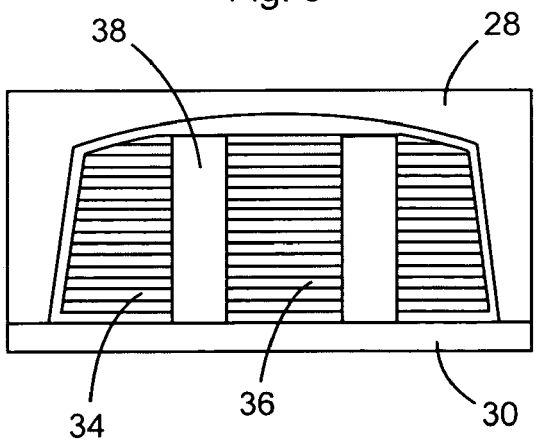
FIG. 6 is a sectional side view of a mold enclosing the golf club head as seen from the front.

As shown in FIG. 2, body 12 is comprised of an inner composite core 20 enclosed in an outer sheath 22. Core 20 may be formed of an injection molded metal and polymer blend as illustrated in FIGS. 2 and 3, or a plurality of layers or sheets of metal and plastic as shown in FIG. 6. When initially contacting a ball B, head 10 held slightly, e.g., about 0.25 inch above the ground, initially contacts ball B with impact area 18, which propels ball B forward with little or no rotation. As ball B continues forward, and head 10 moves forward in an arc, ball B is contacted at an upward tangent by insert 16, which due to the frictional engagement between insert 16 and ball B, causes ball B to rotate forward, improving the accuracy of the putt.

Figure 4:
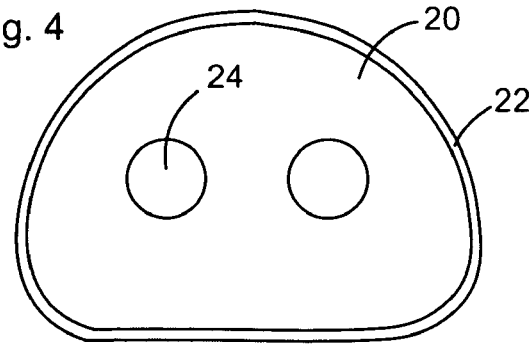
FIG. 4 is a sectional bottom view of the head.

FIG. 4 depicts a bottom view of head 10, illustrating the composite core 20 and covering 22. Parallel bores 22 in core 20 are used to receive support rods during molding.

Figure 5:
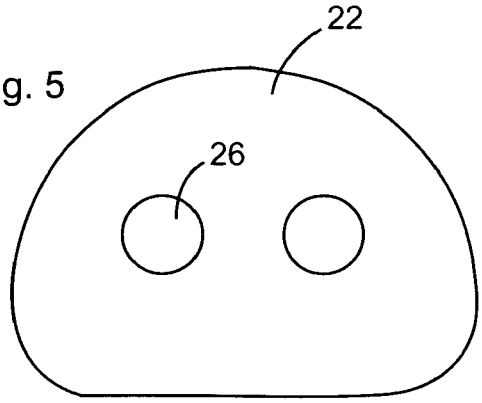
FIG. 5 is a bottom view of the head.

FIG. 5 is a bottom view of the finished head 10 with caps 24 covering bores 22.

FIG. 6 is a sectional side view of an alternative embodiment of the invention within mold sections 26 and 28. Instead of a composite core of metal particles held within a polymer matrix, core 30 is comprised of layers of metal sheets 32 and plastic sheets 34. The sheets preferably, but not necessarily, alternate. Changing the ratio or dimensions of the metal and plastic layers changes the weight of the head without changing its outer dimensions. Rods 36 extend from mold section 28 to support sheets 32 and 34 during molding.

Figure 7:
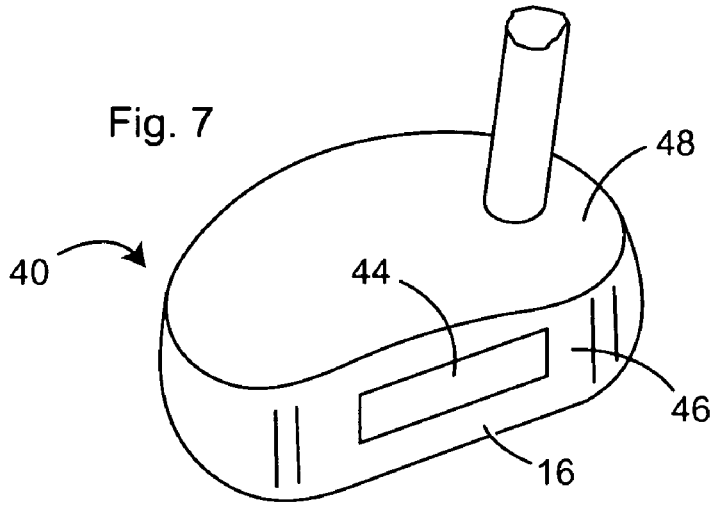
FIG. 7 is a perspective view of a putter head in which a front section of a non-resilient core extends to the putter face to form the initial ball striking area, with the remainder of the core, including the area beneath the non-resilient front section being covered by a resilient sheath, so that the resilient sheath beneath the non-resilient front section will strike the ball after the ball is struck by the non-resilient front core section.
Figure 8:
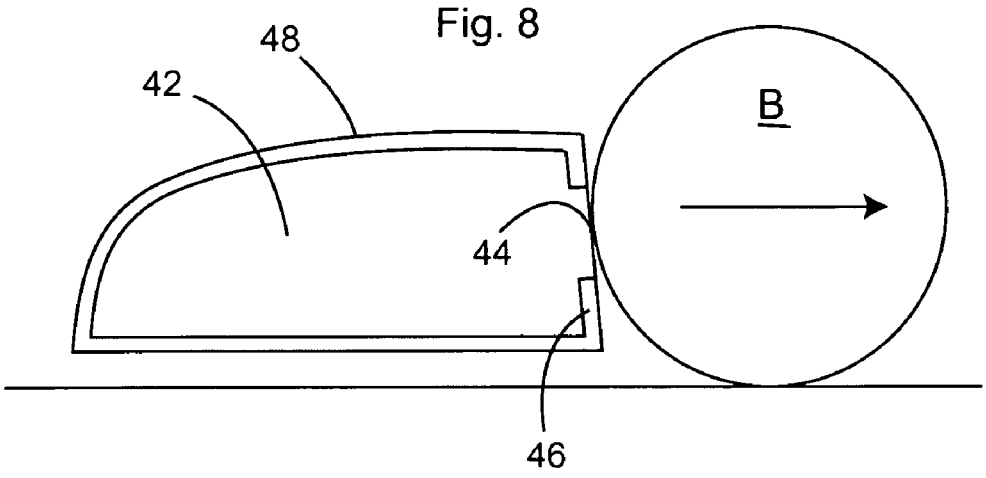
FIG. 8 is a sectional side view of the golf club head of FIG. 7 initially striking a golf ball.
Figure 9:
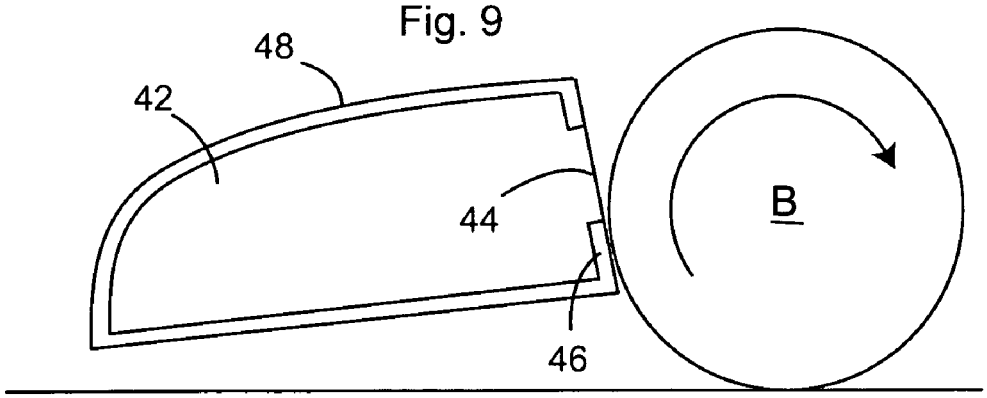
FIG. 9 is a sectional side view of the golf club head of FIG. 7 showing contact of a golf ball with the resilient insert to impart spin to the ball.

FIGS. 7, 8 and 9 illustrate an embodiment of the invention in which putter head, generally 40, is comprised of a non-resilient core 42 having a front section 44 with a front surface in a plane with putter head face 46. Core 42, except for the front surface of section 44, is enclosed in sheath 48 formed of a resilient plastic or elastomer. When using putter head 40, the golf ball B will be initially struck by the non-resilient front surface of section 44 as shown in FIG. 8, and then will be struck by section 50 of resilient sheath 48 beneath the core section 44 as shown in FIG. 9.

Certain modifications and improvements will occur to those skilled in the art upon a reading of the foregoing description. It should be understood that such modifications and improvements have been deleted herein for the sake of conciseness and readability but are properly within the scope of the following claims.

What is claimed is:

1. A golf club head comprising:

a) a composite core of a metal and a plastic; and b) an injection molded sheath enclosing said core, said head includes a front surface with an outer face, a lower edge and a non-resilient ball initial impact area, said club head further including a resilient section having a face in a plane with said front surface outer face, a lower edge aligned with said front surface lower edge, and an upper edge below said ball initial impact area.

2. The golf club head of claim 1, wherein said composite core is formed of layers of metal and plastic.

3. The golf club head of claim 1, wherein said composite core is formed of an injection molded plastic having metal particles dispersed therein.

4. The golf club head of claim 1, wherein said sheath has metal particles dispersed therein.

5. The golf club head of claim 1, wherein said metal and plastic forming said core are present in a ratio of from about 90:10 to about 10:90.

6. The golf club head of claim 1, wherein the metal in said core is selected from the group consisting of beryllium, copper, steel, aluminum, steel, nickel, titanium, and mixtures and alloys thereof.

7. The golf club head of claim 1, wherein the plastic in said core is selected from the group consisting of nylon or polycarbonate.

8. A golf club putter head for use in striking a golf ball comprising:

a) a main body having a front surface with an outer face, a lower edge, a recess in the lower edge, and a non-resilient ball initial impact area above said recess; and b) a resilient section within said recess having a face in a plane with said front surface outer face, a lower edge aligned with said front surface lower edge, and an upper edge below said ball initial impact area, whereby said ball will be initially struck by said non-resilient initial impact area and then by said resilient section.

9. The golf club putter head of claim 8, wherein said putter head lower edge has a given width, and said resilient section is a resilient insert having a width of from about 50% to about 80% of said given width, said insert being centered along said lower edge.

10. The golf putter head of claim 8, wherein said resilient section has a durometer value of from about 40 to about 80.

11. A golf club putter head having a front surface with a substantially planar face, a lower edge and a non-resilient ball initial impact area, said club head comprising:

a) a non-resilient core formed of an injection molded plastic having metal particles dispersed therein, the weight to weight ratio of said metal and polymer being from about 90:10 to about 10:90 having a forward section with a front surface in a plane with the planar face of said putter head front surface, said core section front surface forming said ball impact area; and b) a resilient sheath enclosing said core except for said core forward section front surface, said sheath including a resilient striking surface beneath said core forward section front surface, said resilient striking surface having a face in a plane with said front surface face, a lower edge aligned with said front surface lower edge, and an upper edge below said ball initial impact area.

12. The golf club head of claim 11, wherein said non-resilient core is formed of a metal selected from the group consisting of beryllium, copper, steel, aluminum, steel, nickel, titanium, and mixtures and alloys thereof.

13. The golf club head of claim 11, wherein said sheath has a thickness of from about 0.125 to about 0.25 inch.

14. The golf club head of claim 11, wherein said sheath front section upper edge is from about 0.6 inch above said front surface lower edge.

15. A golf club putter head for use in striking a golf ball comprising:

a) a main body of a solid material having a planar front surface with an outer face, a lower edge, a recess in the lower edge, and a non-resilient ball initial impact area above said recess; and b) a resilient insert within said recess, said insert having a face in a plane with said front surface face, a lower edge aligned with said front surface lower edge, and an upper edge below said ball initial impact area, whereby said ball will be initially struck by said non-resilient initial impact area and then by said resilient section.

16. The golf club putter head of claim 15, wherein said main body lower edge has a given width and said resilient insert has a width of from about 50% to about 80% of said given width.

17. The golf club putter head of claim 15, wherein said resilient insert is constructed of a resilient material selected from the group consisting of rubber, resilient plastic and elastomers.

18. The golf club head of claim 15, wherein said initial impact area is about 0.6 inch above said front surface lower edge.

* * * * *